US010890110B2

(12) United States Patent
Canli et al.

(10) Patent No.: US 10,890,110 B2
(45) Date of Patent: Jan. 12, 2021

(54) INTERNAL COMBUSTION ENGINE WITH A ROTATING PISTON AND UNI-DIRECTIONAL ROLLING BEAR

(71) Applicants: ISTANBUL TEKNIK UNIVERSITESI, Istanbul (TR); MITOS MIKRODALGA GORUNTULEME SISTEMLERI MUHENDISLIK SANAYI VE TICARET LIMITED SIRKETI, Istanbul (TR)

(72) Inventors: Guray Ali Canli, Istanbul (TR); Ibrahim Akduman, Istanbul (TR); Ismail Kurtoglu, Istanbul (TR); Mehmet Cayoren, Istanbul (TR); Hasan Ercan, Istanbul (TR); Haluk Ali Yumlu, Istanbul (TR)

(73) Assignees: ISTANBUL TEKNIK UNIVERSITESI, Istanbul (TR); MITOS MIKRODALGA GORUNTULEME SISTEMLERI MUHENDISLIK SANAYI VE TICARET LIMITED SIRKETI, Istanbul (TR)

( * ) Notice: Subject to any disclaimer, the term of this patent is extended or adjusted under 35 U.S.C. 154(b) by 0 days.

(21) Appl. No.: 16/469,154

(22) PCT Filed: Apr. 19, 2018

(86) PCT No.: PCT/TR2018/050177

§ 371 (c)(1),
(2) Date: Jun. 13, 2019

(87) PCT Pub. No.: WO2019/027400

PCT Pub. Date: Feb. 7, 2019

(65) Prior Publication Data

US 2020/0018229 A1 Jan. 16, 2020

(30) Foreign Application Priority Data

Apr. 20, 2017 (TR) ..... 2017 05836
Apr. 16, 2018 (TR) ..... 2018 05337

(51) Int. Cl.
*F02B 55/02* (2006.01)
*F01C 1/00* (2006.01)
(Continued)

(52) U.S. Cl.
CPC ..... *F02B 55/02* (2013.01); *F01C 1/00* (2013.01); *F01C 1/063* (2013.01); *F01C 20/28* (2013.01);
(Continued)

(58) Field of Classification Search
CPC ..... F01C 1/063; F01C 1/073; F01C 21/02; F01C 21/08; F02B 53/00; F02B 53/02;
(Continued)

(56) References Cited

U.S. PATENT DOCUMENTS 5,433,179 A * 7/1995 Wittry ..... F01C 1/07 123/202
5,537,973 A * 7/1996 Wittry ..... F01C 1/077 123/202
(Continued)

FOREIGN PATENT DOCUMENTS

DE 102015104565 A1 9/2016
WO 03008764 A1 1/2003

*Primary Examiner* — Audrey K Bradley
(74) *Attorney, Agent, or Firm* — Bayramoglu Law Offices LLC

(57) ABSTRACT

An internal combustion engine, includes a 1st rotor having two blades, rotating in the circular volume of the motor body block with variable angular speed; a 2nd rotor having two blades, rotating in the circular volume of the motor body block with variable angular speed, a rolling bearing provided between the 1st rotor and the 2nd rotor enables
(Continued)

rotation of the 1st rotor and the 2nd rotor on each other; a 1st unidirectional rolling bearing between the 1st rotor and the back cover enables rotation of the 1st rotor and the 2nd rotor at different times and at different extents; a 3rd unidirectional rolling bearing transferring the 2nd rotor's rotation movements to the output shaft is provided on the internal collar of the 2nd rotor; a 4th unidirectional rolling bearing transferring the 1st rotor's rotation movements to the output shaft is provided on the internal collar of the 1st rotor.

20 Claims, 8 Drawing Sheets

(51) Int. Cl.

| | |
|---|---|
| ***F01C 20/28*** | (2006.01) |
| ***F01C 21/08*** | (2006.01) |
| ***F01M 1/16*** | (2006.01) |
| ***F02B 53/10*** | (2006.01) |
| ***F02B 53/12*** | (2006.01) |
| ***F02B 55/08*** | (2006.01) |
| ***F02B 55/14*** | (2006.01) |
| ***F01C 1/063*** | (2006.01) |
| ***F01C 21/02*** | (2006.01) |
| ***F02B 53/00*** | (2006.01) |

(52) U.S. Cl.
CPC ..... *F01C 21/02* (2013.01); *F01C 21/08* (2013.01); *F01M 1/16* (2013.01); *F02B 53/00* (2013.01); *F02B 53/10* (2013.01); *F02B 53/12* (2013.01); *F02B 55/08* (2013.01); *F02B 55/14* (2013.01)

(58) Field of Classification Search
CPC ..... F02B 53/12; F02B 55/00; F02B 55/02; F02B 55/14; F04C 2240/52
See application file for complete search history.

(56) References Cited

U.S. PATENT DOCUMENTS

| | | | | |
|---|---|---|---|---|
| 6,886,527 | B2 | 5/2005 | Regev | |
| 2003/0138337 | A1 | 7/2003 | Bahniuk | |
| 2009/0047160 | A1 | 2/2009 | Dec | |
| 2011/0162617 | A1 | 7/2011 | Zhang | |
| 2012/0266841 | A1* | 10/2012 | Sobhani | F02B 53/00 123/245 |
| 2016/0363113 | A1 | 12/2016 | Huang | |

* cited by examiner

INTERNAL COMBUSTION ENGINE WITH A ROTATING PISTON AND UNI-DIRECTIONAL ROLLING BEAR

CROSS REFERENCE TO THE RELATED APPLICATIONS

This application is the national phase entry of International Application No. PCT/TR2018/050177, filed on Apr. 19, 2018, which is based upon and claims priority to the Turkish Patent Application No. 2017/05836, filed on Apr. 20, 2017 and the Turkish Patent Application No. 2018/05337, filed on Apr. 16, 2018, the entire contents of which are incorporated herein by reference.

TECHNICAL FIELD

The present invention is related with an internal combustion engine which is used on any kind of vehicles—fundamentally and primarily on unmanned air vehicles, generators, compressors and pumps.

The invention is more specifically related with an internal combustion engine which eliminates the gear coupling system that provides eccentricity by housing two rotors with the unidirectional rolling bearing, and allows for concentric operation of the shafts on the rotary piston engine system with double rotors.

BACKGROUND

Classical internal combustion engines are heavy and they run inefficiently; and they fail to exactly satisfy the criteria expected from unmanned air vehicles such as low weight/high power, compact structure and low fuel conception. However, they have longer lives.

The requirements of unmanned aircrafts were tried to be covered with the engines which run with the mutual piston motion (classical engine). Rotax engine may be given as an example for that.

Whereas, rotary engines may be given as an example to smaller and more efficient engines. The 1st example of this range of rotary engines is Wankel engines, and they have a triangular, pear-shaped structure. The most important problem of these engines is vibration and they also have the drawbacks of high fuel consumption and short life span. Nevertheless, they are still successfully used in the industry.

These eccentric shafts also provide a predefined periodical mechanical movement form to the pistons, and the rotation speed of the pistons change only with fuel-air mixture and ignition. There are no engines which are affected by the load on the output shaft and which adjust the power by themselves.

Various developments have been realized regarding rotary engines in the prior art.

The US patent document US2016363113 in the prior art describes a friction-free rotary piston scissor action engine. This invention employs two rotary scissor-action piston members symmetrically separating the housing cylinder into two pairs of air chambers. Two pairs of air intakes and air exhausts are strategically positioned in relationship to the two air chambers. A paired gear transmission mechanism, called a "Butterfly Gear", is linked to the rotors to control scissor action. The invention has a bearing ring set in-between the slots of two piston rotor surfaces. There is a bearing on each axle of the rotor to support the weight of rotary piston. There is no physical contact between housing and the piston members, resulting in a friction-free design.

This enables the rotary piston members to rotate at high speed, like turbine blades, and provides high efficiency.

The US patent document US2009047160 in the prior art describes rotary scissor action machines. A reaction gear attached to the 1st gear causes the 1st gear to rotate with respect to the rotating shaft. 1st and 2nd connecting rods are pivotally connected with the 1st gear. 1st and 2nd crank arms are pivotally connected with the respective 1st and 2nd connecting rods. 1st and 2nd coaxial shafts are connected with the respective 1st and 2nd 1st crank arms. The 1st shaft is connected with at least one forward operation member. The 2nd shaft is connected with at least one rearward operation member. The blade rotates with the shaft's movement.

The US patent document U.S. Pat. No. 6,886,527 in the prior art describes a rotary vane motor. According to the invention, the vane motor includes a 1st rotating component and a 2nd rotating component, each with a pair of leading vanes. The vanes rotate within a cylindrical chamber and the cylindrical chamber includes an intake port and an exhaust port. The vanes are driven by a drive shaft. Two drive shafts are connected by a drive train. The drive shafts determine the relative movement of the trailing vane towards and away from the associated leading vane as the vanes rotate about the common central rotation axis and define the stages of the combustion cycle.

The US patent document US2003138337 in the prior art describes an internal combustion engine. The engine comprises a housing defining a cylindrical working chamber having inlet ports and exhaust ports, 1st and 2nd interdigitated piston assemblies which include pistons and which are located crosswise in the said chamber.

However in the exemplary documents, the rotation of the piston vanes on the combustion section of the engines depends on the rotation of the camshaft to which the pistons are connected. Due to the relative rotation of rotors on double rotor engines, the opposite forces on the vanes directly affect the inner and outer gear couple, which form the cam offset. The camshafts on the rotary piston engines do not allow for a counterweight placement, which might balance the vibration that occurs due to their structure. Therefore, the vibration is transmitted along the shaft and the outer gear of the cogwheel, which provides the eccentricity wears out in time. It both causes high vibration and shortens the life span of the component.

These eccentric shafts also provide a predetermined way of movement to the pistons, and they change the rotation speed of pistons just with the change of fuel-air mixture and ignition. There are not any engines which automatically adjust their power regarding to the load on the main shaft.

The lack of an engine which eliminates the gear couple system that provides eccentricity and enables concentric movement of the shafts led to the necessity of developing the subject internal combustion engine with a rotating piston and one-directional rolling bearing of the invention.

SUMMARY

The objective of the invention is to provide an internal combustion engine which eliminates the gear couple system that provides eccentricity by housing two rotors with the unidirectional rolling bearing and allows for concentric operation of the shafts.

The objective of this invention is to provide an internal combustion engine which overcomes the problems such as vibration, shaft and gear wearing out with an concentric power transmission connection provided by the one-directional rolling bearing.

Another objective of this invention is to provide an internal combustion engine which adjusts the power autonomously compared to the load of the engine on the shaft, thus providing a power increase, and as a result simplifies and lightens the power transmission system.

Another objective of this invention is to prevent potentially permanent defects on the engine by constructing the pistons in an asymmetrical structure (with one flat side and another convex or concave side) which prevents their sticking and rotating together due to excessive load increase for any reasons (or as a result of defects) on the output shaft of the pistons, the air-fuel mixture compression of which changes according to the load on the output shaft.

Another objective of this invention is to realize an internal combustion explosion engine in a simple structure, which is light but provides a high power.

The invention uses unidirectional rolling bearings instead of linkages which provide rotary piston timing and transmit the rotation of the eccentric shaft on Vane motor type of engines. Unidirectional rolling bearings houses rotors on the motor body. At the moment combustion is realized in the rooms with variable volume caused by the blades, only one of the blades will attempt to turn in the direction of rotation of the output shaft and the other in the reverse direction. Unidirectional rolling bearings allow the movement only in the direction of rotation of the output shaft. Therefore, while one rotor remains stationary, the other rotor rotates in the direction to rotate the output shaft. The two rotors slow down at different engine times, they rotate in the direction opposite to the output shaft, or they rotate simultaneously. The rotation of the rotors in this way creates a structure which periodically rotates the rotating pistons (rotors) and realizes a similar one of the crank shaft timing that corresponds to the intake, compression, combustion and exhaust times of four-stroke engines. Two or more unidirectional rolling bearings are placed on the output shaft which supported with rotors. These rolling bearings allow the rotation in opposite direction between the unidirectional bearings which houses two rotors to the motor block. As a result, when the rotors rotate, the output shaft and the moving rotor interlock and the power is transmitted.

BRIEF DESCRIPTION OF THE DRAWINGS

The internal combustion engines to achieve the objective of this invention are shown on the annexed figures.

These figures are.

Figure 1:
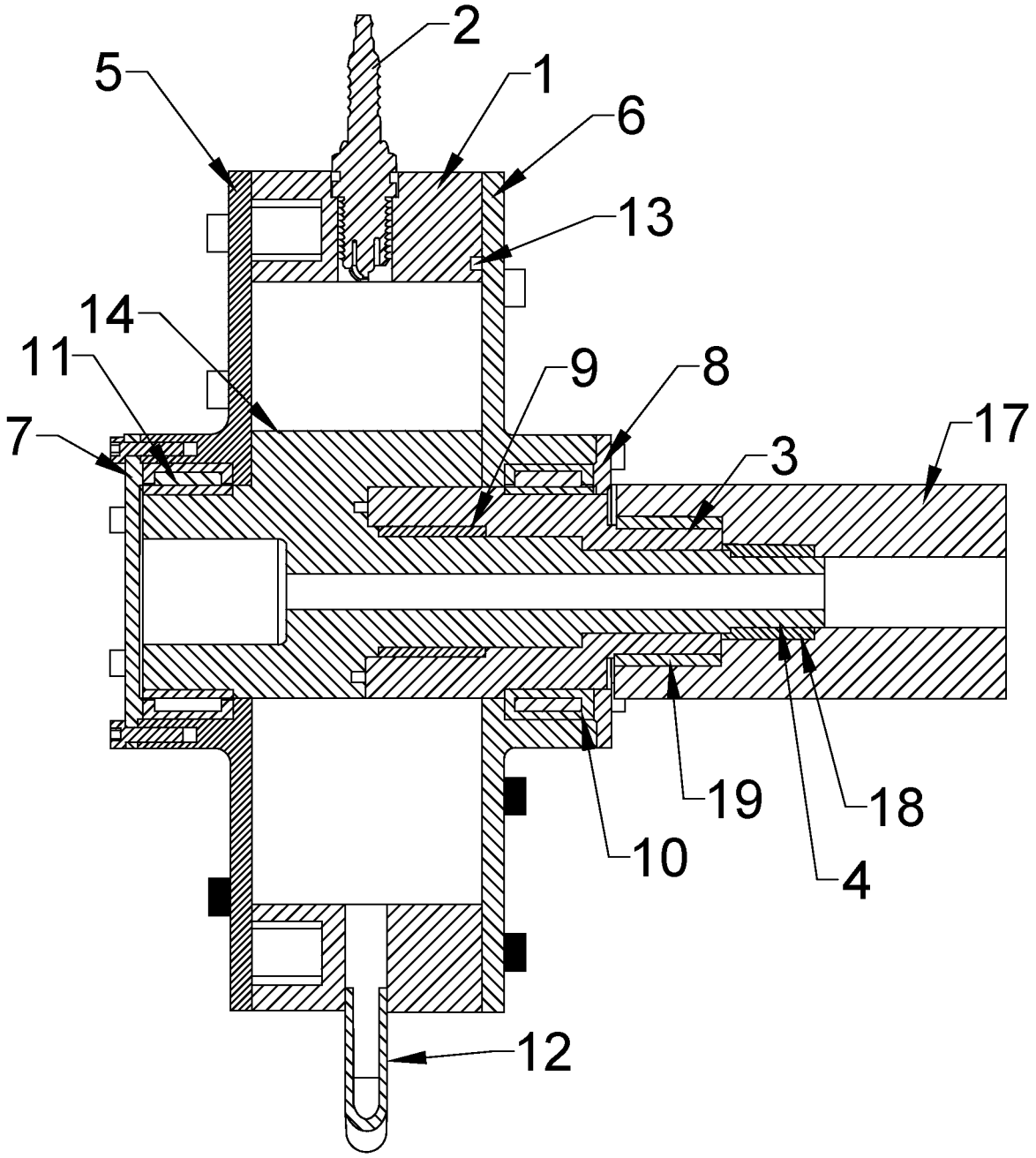
FIG. 1: Sectional view of the invented internal combustion engine.

The parts on the figures have been numbered one by one, and these numbers refer to the following items:

1. Motor body block
2. Sparking plug
3. 1st Rotor
4. 2nd Rotor
5. Front cover
6. Back cover
7. Roller bearing front cover
8. Roller bearing back cover
9. Roller bearing
10. 1. Unidirectional roller bearing
11. 2. Unidirectional roller bearing
12. Discharge pipe
13. 1st Sealing component
14. 2nd Sealing component
15. Fuel-air mixture pipe
16. 3rd Sealing component
17. Output shaft
18. 3rd Unidirectional roller bearing
19. 4th Unidirectional roller bearing
20. Compression ring
21. Oil ring
22. Lubrication valve ball
23. Oil discharge hole
24. Rotor structure
25. Coil
26. Hall effect sensor

DETAILED DESCRIPTION OF THE EMBODIMENTS

The invention is an internal combustion explosion motor, wherein

A motor body block (1) with an interface on which the front cover (5) and back cover (6) components are connected by means of bolts, and which has a circular empty volume including variable volumes in which the engine's combustion, compression, intake and exhaust strokes occur, A sparking-plug (2) connected on the motor body block (1) which enables the combustion of the fuel-air mixture, A 1st rotor (3) supported from the inner ring of the 1st unidirectional rolling bearing (10) supported from the outer ring to the back cover (6), which has two blades, rotating in the circular volume of the motor body block (1) with variable angular speed, A 2nd rotor (4) supported with the inner ring of the 2nd unidirectional rolling bearing (11) which housed from the outer ring to the front cover (5), which has two blades, rotating in the circular volume of the motor body block (1) with variable angular speed, which enables rotation of the 1st rotor (3) and 2nd rotor (4) at different times, A rolling bearing (9) which is present between the 1st rotor (3) and the 2nd rotor (4), which enables bearing the 1st rotor (3) and the 2nd rotor (4), and allows for its rotation, A 1st unidirectional rolling bearing (10) which is present between the 1st rotor (3) and the back cover (6), which enables rotation of the 1st rotor (3) and the 2nd rotor (4) at different times and at different amounts, A 2nd unidirectional rolling bearing (11) which is present between the 2nd rotor (4) and the front cover (5), which enables rotation of the 1st rotor (3) and the 2nd rotor (4) at different times and at different extents, An exhaust discharge pipe (12) which discharges exhaust gases and which is connected on the motor body block (1), A fuel-air mixture pipe (15) which supplies fuel-air mixture to the combustion rooms, An output shaft (17) which transmits the rotation of the 1st rotor (3) and the 2nd rotor (4) on single shaft, and which turns at different angular speeds and in different periods, The 3rd unidirectional rolling bearing (18) which transfers the 2nd rotor's (4) rotation to the output shaft (17) and which provides housing by the inner ring to the 2nd rotor (4), The 4th unidirectional rolling bearing (19) which transfers the 1st rotor's (3) rotation to the output shaft (17) and which provides housing by the inner ring to the 1st rotor (3), At least one U-shaped compression rings (20) and oil rings (21) which enable lubrication, which expand by heat and which are present on the 1st rotor (3) and the 2nd rotor (4), The lubrication valve ball (22) which enables lubrication of the engine while running, Oil discharge hole (23) which lubricates the engine with sufficient amount of oil pro rata to the rotation speed of the 1st rotor (3) and 2nd rotor (4) and which circulates the shared lubricant for cooling and lubricating the motor body block (1) also in the 1st rotor (3) and the 2nd rotor (4) in addition to the casing of the motor body (1), The asymmetric rotor structure (24) with one flat side and one concave or convex side, which prevents sticking together of the 1st rotor (3) and the 2nd rotor (4) when the load on the output shaft (17) is very high.

The invention is an internal combustion engine; which comprises a 1st sealing component (13) used for ensuring external and internal sealing between the front cover (5) and the back cover (6).

The invention is an internal combustion engine, which includes a 2nd sealing component (14) used for blocking external or internal foreign substance entrance at the fuel input or output and reducing friction between the 1st rotor (3) and the 2nd rotor (4).

The invention is an internal combustion engine and it includes a 3rd sealing component (16) which enables sealing with low friction coefficient and which is located on the blades of the 1st rotor (3) and the 2nd rotor (4).

The invention is an internal combustion engine, which includes a hall effect sensor (26) which is located on the engine's body block (1) and used to measure whether there is a shift in the 1st rotor's (3) and 2nd rotor's (4) synchronization.

Motor body block (1) is a component with an interface on which the front cover (5) and back cover (6) components are connected by means of bolts, and which has a circular empty volume including variable volumes in which the engine's combustion, compression, intake and exhaust strokes occur. The sparking plug (2), fuel-air pipe (15) and the discharge pipe (12) are connected on the motor body block (1).

The 1st rotor (3) and the 2nd rotor (4) are located in the circular volume of the motor body block (1). The sealing between the 1st rotor's (3) and the 2nd rotor's (4) blades, and the sealing between the front cover (5) and back cover (6) are provided with the 1st sealing component (13) and the 2nd sealing component (14) which are commonly used on the engines with rotary pistons.

The 1st rotor (3) is housed by the inner ring of the 1st unidirectional roller bearing (10) which is housed to the back cover (6) by the outer ring. The 2nd rotor (4) housed by the inner ring of the 2nd unidirectional roller bearing (11) which is housed to the front cover (5) by the outer ring. The 1st unidirectional roller bearing (10) and the 2nd unidirectional roller bearing (11) enables concentricity of the 1st rotor (3) and the 2nd rotor (4).

The rolling bearing front cover (7) presses on the 1st unidirectional roller bearing's (10) outer ring and the roller bearing back cover (8) presses on the outer ring of the 2nd unidirectional roller bearing (11), thus they prevent the axial movement of the 1st unidirectional roller bearing (10) and the 2nd unidirectional roller bearing (11). The rolling bearing front cover (7) and the rolling bearing back cover (8) are centered on the front cover (5) and the back cover (6) with a projection which was a sensitive tolerance.

The 1st unidirectional roller bearing (10) and the 2nd unidirectional roller bearing (11) which provides housing to the 1st rotor (3) and the 2nd rotor (4) define the rotation direction and sequence of the 1st rotor (3) and the 2nd rotor (4). It is important for the 1st unidirectional roller bearing (10) and 2nd unidirectional roller bearing (11) to not rotate above the defined shaft rotation speed in order to avoid their mechanical malfunction.

There is a 3rd unidirectional roller bearing (18) which and which provides housing to the 2nd rotor (4) by its inner ring there is a 4th unidirectional roller bearing (19) housed by the inner ring of the 1st rotor (3) and they transfer 1st rotor's and 2nd rotor's (4) rotation to the output shaft (17).

When the 2nd rotor (4) rotates clockwise, the 3rd unidirectional rolling bearing (18) which supported with the 2nd rotor (4) is locked and it rotates the output shaft (17) clockwise. While the 1st rotor (3) is fixed with the 4th unidirectional roller bearing's (19) inner ring, the outer ring of the 4th unidirectional roller bearing (19) rotates clockwise with the output shaft (17). As a result, the rotation of the 1st rotor (3) and the 2nd rotor (4) which rotate in periodic movements turns into a continuous movement on the output shaft (17).

In other words, the 3rd unidirectional roller bearing (18) and the 4th unidirectional roller bearing (19) supported with the 1st rotor (3) and the 2nd rotor (4). The 3rd unidirectional roller bearing (18) and the 4th unidirectional roller bearing (19) are housed in a manner that allows to rotate in the opposite direction with respect to the 1st unidirectional rolling bearing (10) and the 2nd unidirectional rolling bearing (11) which provides housing to the 1st rotor (3) and the 2nd rotor (4). In other words, the 1st unidirectional roller bearing (10) and the 2nd unidirectional roller bearing (11) which supports the 1st rotor (3) and the 2nd rotor (4) allows to rotate in the same direction with the 1st rotor (3) and the 2nd rotor (4), while the output shaft (17) and the 3rd unidirectional roller bearing (18) and 4th unidirectional roller bearing (19) which provides housing to the 1st rotor (3) and the 2nd rotor (4) allow to rotate in the opposite direction of the 1st rotor (3) and the 2nd rotor (4). As a result, when the 1st rotor (3) and the 2nd rotor (4) rotates, the output shaft and the moving rotor interlock and the power is transmitted.

Figure 2:
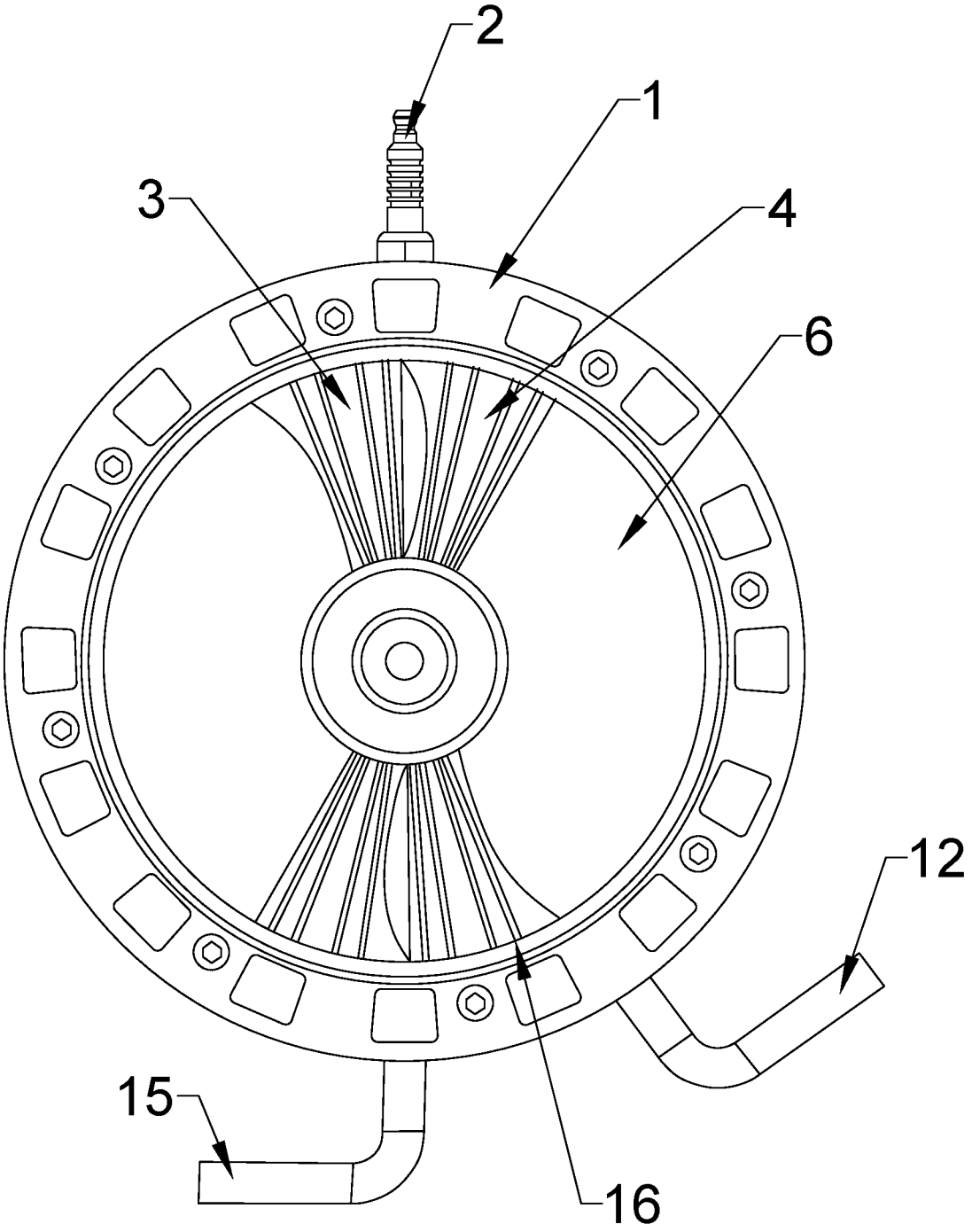
FIG. 2: The view of the position of the rotary blades in the combustion phase where the fuel-air mixture is compressed in invented internal combustion engine.

Two symmetrical volumes were created for each one of the 1st rotor (39 and 2nd rotor (4) blades, at the position where their fuel-air mixture is in the combustion phase (FIG. 2) in the motor body block. The force of the combustion which occurs when the fuel-air mixture is ignited rotates the 2nd rotor (4) clockwise with the blade on the right side. The 1st rotor (3) does not move. As the 2nd rotor (4) completes its variable angular movement, it compresses the other volume to enable the discharge of the exhaust gases in it through the discharge pipe (12). The fuel-air mixture is compressed in the symmetrical side of this chamber. In the other volume, the fuel-air mixture is taken in the variable volume through the fuel-air mixture pipe (15).

Figure 3:
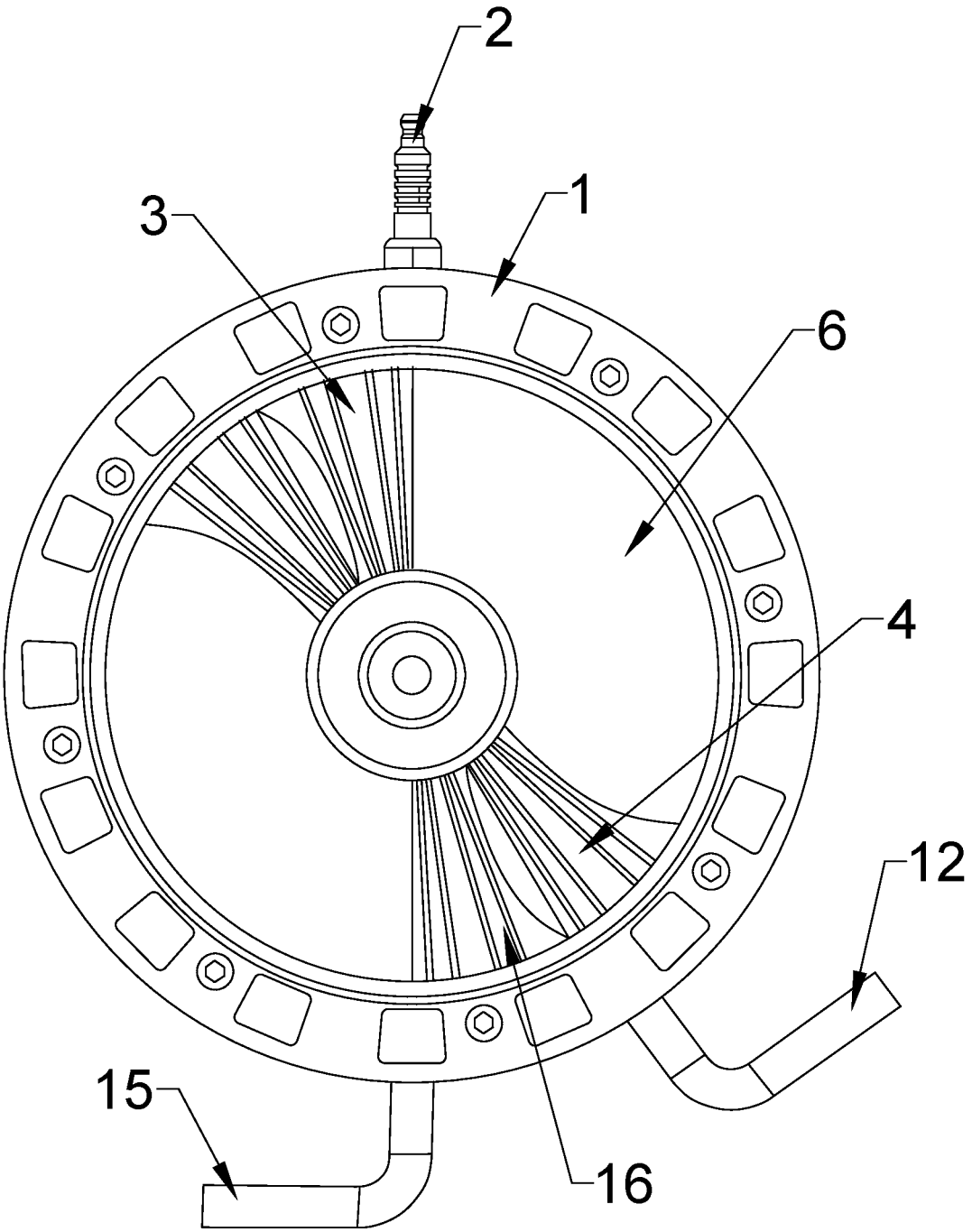
FIG. 3: The view of the clockwise rotation of the invented internal combustion engine when the rotors rotate together clockwise.
Figure 4:
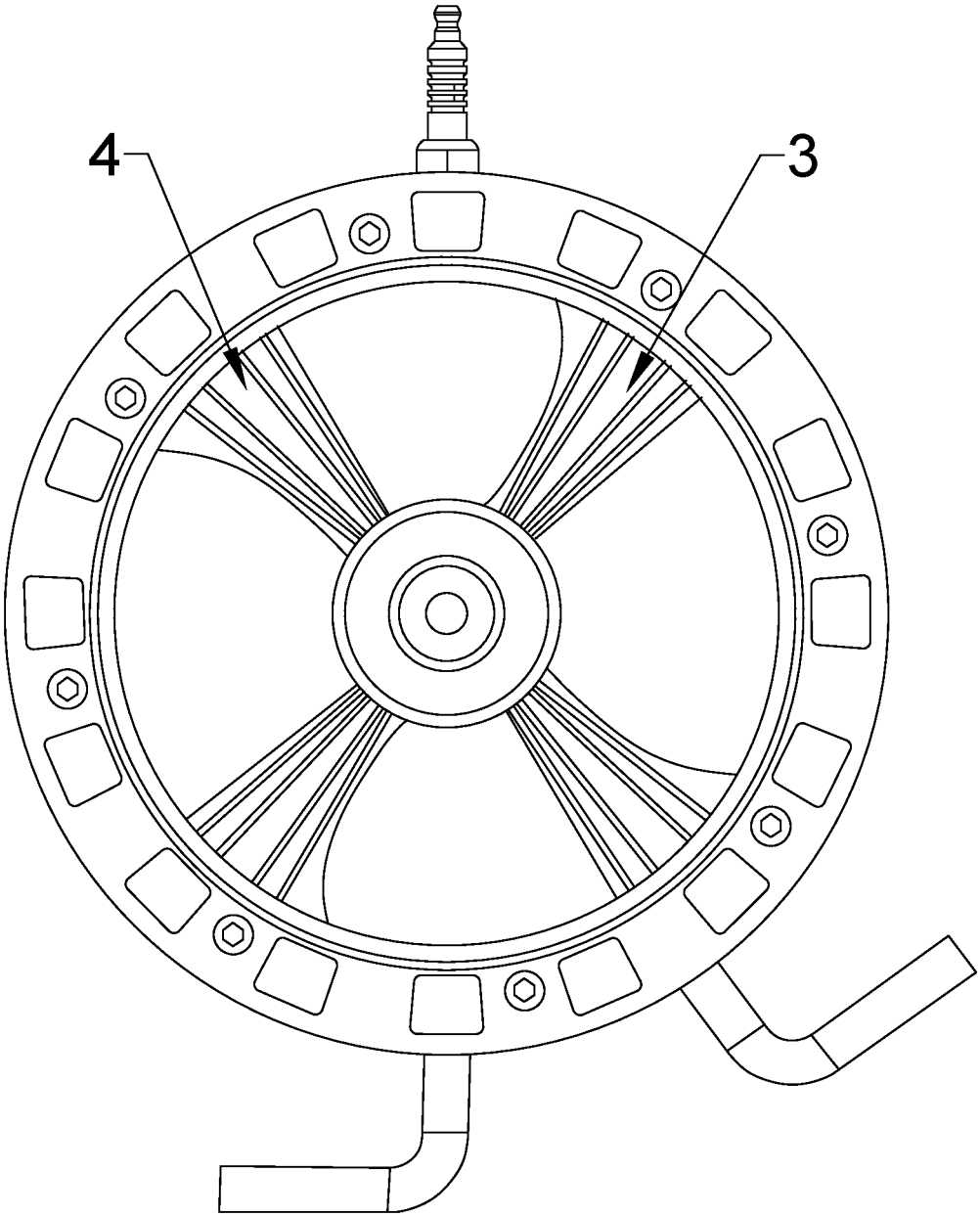
FIG. 4: View of the separated positions of the structure of rotors reciprocally with one flat and one concave side, which minimizes the contact surface of rotors.
Figure 5:
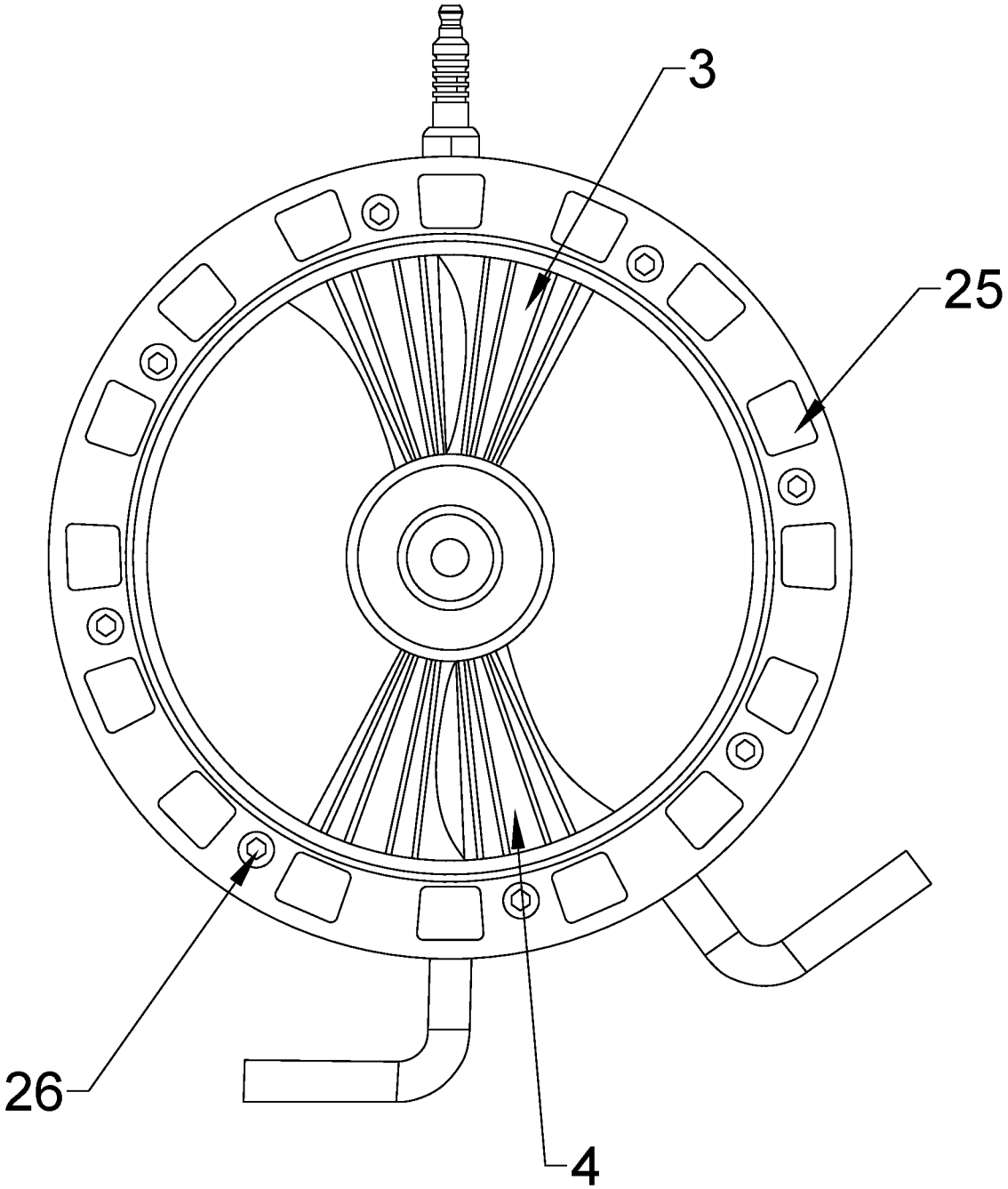
FIG. 5: View of the positions of the structure of rotors before the combustion phase reciprocally with one flat and one concave side, which minimizes the contact surface of rotors.

At different engine phases, the 1st rotor (3) and the 2nd rotor (4) turn clockwise one by one or together. After the 1st rotor (3) begins to rotate following the combustion phase, it meets the blades of the 2nd rotor (4) and they push each other and bring each other to the previous position of the 1st rotor (3) before this motion. FIG. 3 shows the phase that the 1st rotor (3) and the 2nd rotor (4) rotate clockwise together.

Figure 8:
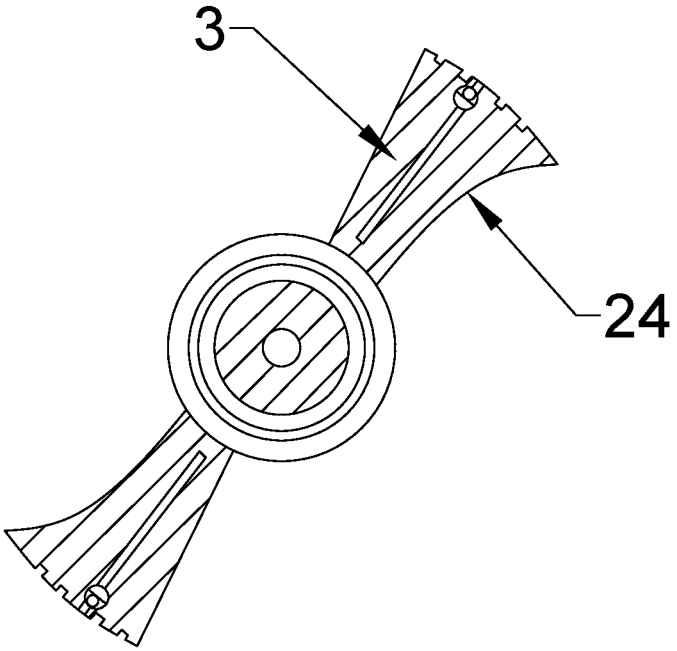
FIG. 8: View of the rotor structure and the rotor in the invented internal combustion engine.

The rotor structure (24) of the 1st rotor (3) and the 2nd rotor (4) as can be seen in FIG. 8 is flat on one side and concave on the other side in order to avoid sticking of the 1st rotor (3) and the 2nd rotor (4) to each other when the torque is exerted on the engine output shaft (17) is very high, thus not creating the force required for rotation and prevent any damages to the engine. However, this may be convex in alternative embodiments.

Figure 6:
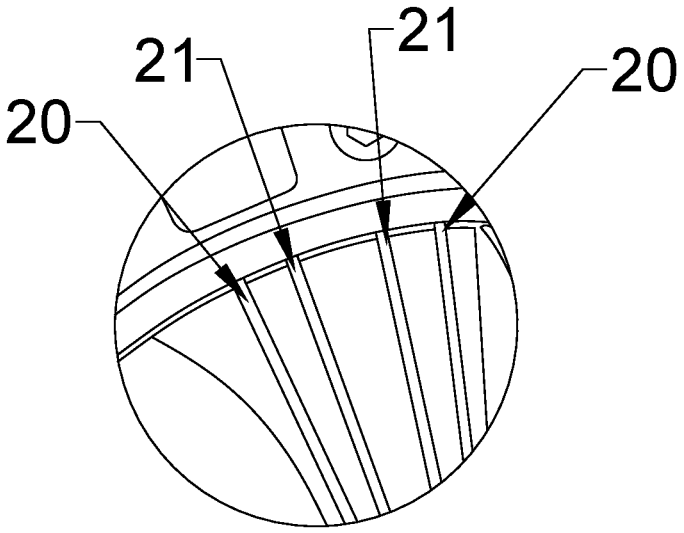
FIG. 6: The view of the oil and compression rings, which contains four pieces on each rotor in the invented internal combustion engine.
Figure 7:
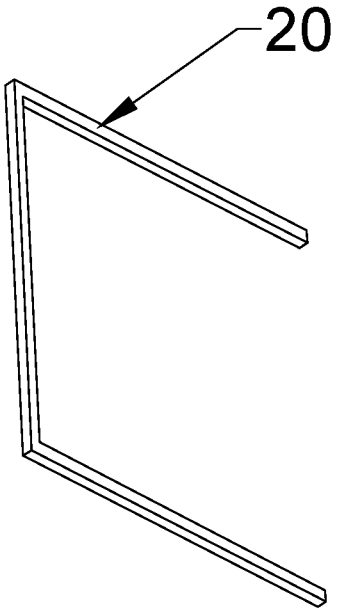
FIG. 7: Perspective view of the compression ring in the invented internal combustion engine.

There are four rings on the 1st rotor (3) and the 2nd rotor (4). There are two compressing rings (20) and two oil rings (21) on each piston. The compressing ring (20) and the oil ring (21) fulfill the functions of continuing lubrication without any problems and reducing the impact of friction. FIG. 6 shows the layout and structure of these rings on the pistons.

Figure 9:
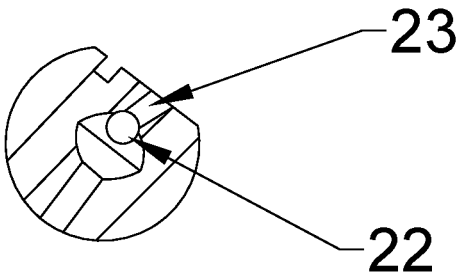
FIG. 9: View of the position of the lubrication valve ball in the rotor of the invented internal combustion engine.
Figure 10:
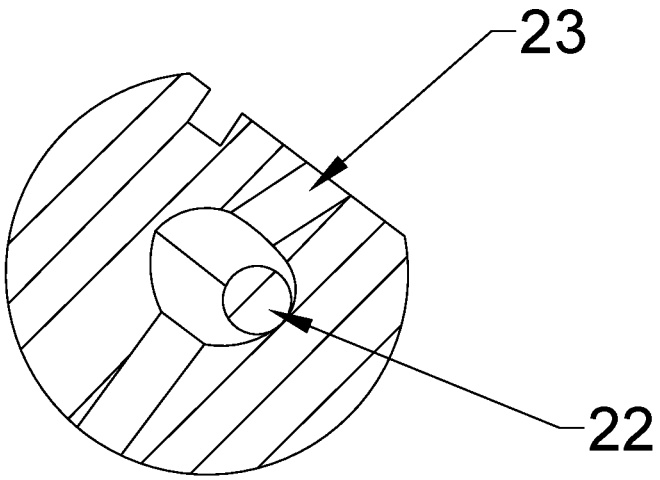
FIG. 10: View of the position of the lubrication valve ball during lubrication between rotors and the engine block.

In the motor body block (1) in which the 1st rotor (3) and the 2nd rotor (4) rotate, the oil valves are placed in the rotors to lubricate. The lubricant is supplied with the channels passing through the 1st rotor (3) and the 2nd rotor (4). When the 1st rotor (3) and the 2nd rotor (4) are motionless, in order to stop lubrication and prevent oil leakage, the lubrication valve ball (22) enables the oil to leave the 1st rotor (3) and the 2nd rotor (4) and blocks the oil discharge hole which is located at the point that the oil reaches the motor body block (1) and oil rings (21). FIG. 9 shows the position of the lubrication vane ball (22) in the 1st rotor (3). As the rotation of the 1st rotor (3) and the 2nd rotor (4) is a periodic movement, the angular acceleration of the 1st rotor (3) and the 2nd rotor (4) are variable. Therefore, the oil valve ball (22) enters the concave socket in the oil valve with the forces received from centrifuge and acceleration while acting in the 1st rotor (3) and the 2nd rotor (4). As a result, the oil discharge hole (23) remains open, and lubrication continues between the 1st rotor (3) and the 2nd rotor (4), and the motor body's block (1). FIG. 10 shows the position of the oil valve ball (22) while lubrication continues between the 1st rotor (3), 2nd rotor (4) and the motor body block (1).

The Hall effect sensor (26) defines the angular position of the 1st rotor (3) and the 2nd rotor (4) and identifies whether there is a shift in the synchronization of the 1st rotor (3) and the 2nd rotor (4).

When the Hall effect sensor (26) identifies a shift in the synchronization of the 1st rotor (3) and the 2nd rotor (4), it considers the measured position information and changes the direction or strength of the flow passing through the coils (25) with the known methods of the technique and decreases or increases the speed of the 1st rotor (3) and the 2nd rotor (4). As a result, the angular speed of the deflected or fast-going 1st rotor (3) and/or 2nd rotor (4) is changed and synchronization is ensured. In the meantime, as the hall effect sensor (26) determines the positions of the 1st rotor (3) and the 2nd rotor (4), it also enables determining the engine strokes.

What is claimed is:

1. An internal combustion engine, comprising:

a motor body block having an interface, wherein a front cover and a back cover are connected on the interface by means of bolts, and the motor body block includes a hollow circular volume for engine's combustion, compression, intake and exhaust strokes, a sparking-plug connected on the motor body block enabling combustion of a fuel-air mixture, an exhaust discharge pipe for discharging exhaust gases is connected on the motor body block, a fuel-air mixture pipe for supplying the fuel-air mixture to combustion rooms, and an output shaft for collecting movements of a first rotor and a second rotor on a single shaft, and the output shaft is configured to turn at different angular speeds in different periods, wherein;

the first rotor is supported with an inner ring of a first unidirectional rolling bearing supported with the output shaft to the back cover, the first rotor has two blades rotating in the hollow circular volume of the motor body block with a variable angular speed, a second rotor is supported with an inner ring of a second unidirectional rolling bearing supported with the output shaft to the front cover, the second rotor has two blades rotating in the hollow circular volume of the motor body block with the variable angular speed, a rolling bearing is provided between the first rotor and the second rotor, a third unidirectional rolling bearing enables rotation and bearing of the first rotor and the second rotor on each other, the first unidirectional rolling bearing and the second unidirectional rolling bearing enables rotation of the first rotor and the second rotor at different times and at different extents, the third unidirectional rolling bearing is provided on an inner collar of the second rotor and is configured to transfer a rotational movement of the second rotor to the output shaft, and a fourth unidirectional rolling bearing is provided on an internal collar of the first rotor and is configured to transfer a rotational movement of the first rotor to the output shaft.

2. The internal combustion engine according to claim 1, further comprising a lubrication valve ball for providing lubrication of the internal combustion engine during running.

3. The internal combustion engine according to claim 1, further comprising an oil discharge hole configured to lubricate the internal combustion engine with an amount of oil pro rata to the rotation speed of the first rotor and the second rotor and circulate a shared lubricant for cooling and lubricating the motor body block.

4. The internal combustion engine according to claim 1, further comprising a hall effect sensor configured to change a direction or strength of a flow passing through coils on the motor body block and correcting synchronization shifts occurring on the first rotor and the second rotor and for determining engine strokes.

5. The internal combustion engine according to claim 1, further comprising at least one U-shaped compression ring and at least one U-shaped oil ring for providing lubrication, the at least one U-shaped compression ring and the at least one U-shaped oil ring are configured to expand by heat and are provided on the first rotor and the second rotor.

6. The internal combustion engine according to claim 5, further comprising a lubrication valve ball for providing lubrication of the internal combustion engine during running.

7. The internal combustion engine according to claim 1, further comprising an asymmetric rotor structure with one flat side and one concave or convex side, preventing the first rotor and the second rotor from sticking together.

8. The internal combustion engine according to claim 7, further comprising at least one U-shaped compression ring and at least one U-shaped oil ring for providing lubrication, the at least one U-shaped compression ring and the at least one U-shaped oil ring are configured to expand by heat and are provided on the first rotor and the second rotor.

9. The internal combustion engine according to claim 7, further comprising a lubrication valve ball for providing lubrication of the internal combustion engine during running.

10. The internal combustion engine according to claim 1, further comprising a first sealing component for external and internal sealing between the front cover and the back cover.

11. The internal combustion engine according to claim 10, further comprising at least one U-shaped compression ring and at least one U-shaped oil ring for providing lubrication, the at least one U-shaped compression ring and the at least one U-shaped oil ring are configured to expand by heat and are provided on the first rotor and the second rotor.

12. The internal combustion engine according to claim 10, further comprising a lubrication valve ball for providing lubrication of the internal combustion engine during running.

13. The internal combustion engine according to claim 10, further comprising a hall effect sensor configured to change a direction or strength of a flow passing through coils on the motor body block and correcting synchronization shifts occurring on the first rotor and the second rotor and for determining engine strokes.

14. The internal combustion engine according to claim 10, further comprising a second sealing component for blocking external or internal foreign substance entrance at a fuel input or output and reducing a friction between the first rotor and the second rotor.

15. The internal combustion engine according to claim 14, further comprising at least one U-shaped compression ring and at least one U-shaped oil ring for providing lubrication, the at least one U-shaped compression ring and the at least one U-shaped oil ring are configured to expand by heat and are provided on the first rotor and the second rotor.

16. The internal combustion engine according to claim 14, further comprising a lubrication valve ball for providing lubrication of the internal combustion engine during running.

17. The internal combustion engine according to claim 14, further comprising a hall effect sensor configured to change a direction or strength of a flow passing through coils on the motor body block and correcting synchronization shifts occurring on the first rotor and the second rotor and for determining engine strokes.

18. The internal combustion engine of claim 14, further comprising a third sealing component provided on the blades of the first rotor and the second rotor for providing sealing with a friction coefficient.

19. The internal combustion engine according to claim 18, further comprising at least one U-shaped compression ring and at least one U-shaped oil ring for providing lubrication, the at least one U-shaped compression ring and the at least one U-shaped oil ring are configured to expand by heat and are provided on the first rotor and the second rotor.

20. The internal combustion engine according to claim 18, further comprising a lubrication valve ball for providing lubrication of the internal combustion engine during running.

* * * * *